US011529723B2

(12) United States Patent
Taylor

(10) Patent No.: US 11,529,723 B2
(45) Date of Patent: Dec. 20, 2022

(54) INDUSTRIAL FAN BUSHING REPLACEMENT TOOL

(71) Applicant: Jeremey Taylor, Steubenville, OH (US)

(72) Inventor: Jeremey Taylor, Steubenville, OH (US)

( * ) Notice: Subject to any disclaimer, the term of this patent is extended or adjusted under 35 U.S.C. 154(b) by 0 days.

(21) Appl. No.: 16/983,576

(22) Filed: Aug. 3, 2020

(65) Prior Publication Data

US 2021/0031345 A1 Feb. 4, 2021

Related U.S. Application Data

(60) Provisional application No. 62/881,649, filed on Aug. 1, 2019.

(51) Int. Cl.
*B25B 27/06* (2006.01)
*B25B 27/00* (2006.01)

(52) U.S. Cl.
CPC ..... *B25B 27/06* (2013.01); *B25B 27/0028* (2013.01)

(58) Field of Classification Search
CPC .. B23Q 3/00; B23Q 3/06; B23Q 3/063; B23P 19/02; B23P 19/04; B23P 19/00; B23P 19/10; B25B 27/02; B25B 27/023; B25B 27/026; B25B 27/14; B25B 27/06; B25B 27/0028; B25B 27/28; Y10T 29/53878; Y10T 29/53857; Y10T 29/53891; Y10T 29/5383; Y10T 29/53657
USPC ..... 29/235, 281.1, 281.4, 281.5, 281.6, 239; 269/55
See application file for complete search history.

(56) References Cited

U.S. PATENT DOCUMENTS

| | | | | |
|---|---|---|---|---|
| 1,385,452 | A * | 7/1921 | Hoffman | B25B 27/023 29/256 |
| 4,096,531 | A * | 6/1978 | Yamada | H01J 29/766 348/829 |
| 4,492,014 | A * | 1/1985 | Alexander | B25B 27/023 29/259 |
| D373,059 | S * | 8/1996 | Hodges | D8/51 |
| 6,098,261 | A * | 8/2000 | Goguen | F16C 19/548 29/280 |
| 6,539,601 | B1 * | 4/2003 | Cloward | B25B 27/062 29/263 |

* cited by examiner

*Primary Examiner* — Joseph J Hail
*Assistant Examiner* — Robert C Moore
(74) *Attorney, Agent, or Firm* — Eric J. Sosenko; Jonathan P. O'Brien; Honigman LLP

(57) ABSTRACT

A bushing installation tool having a plurality of spacer rods with first and second ends and a pressure plate mounted to the first ends of the spacer rods. A first base includes portions configured to engage an end of a cylindrical bushing and to restrain radial expansion of a cylindrical bushing received. The bushing installation tool has a first stage in which the first base being releasably engage with the second ends of the spacer rods. A second base including portions configured to engage the end of the cylindrical bushing and to permit radial expansion of the cylindrical bushing engaged therewith. The second base also including portions configured to releasably engage the second ends of the spacer rods and being alternatively interchangeable with the first base. The bushing installation tool includes a second stage in which the second base is releasably engaged with the second ends of the spacer rods.

20 Claims, 12 Drawing Sheets

INDUSTRIAL FAN BUSHING REPLACEMENT TOOL

CROSS REFERENCE TO RELATED APPLICATION

This application is a nonprovisional patent application claiming priority to provisional patent application No. 62/881,649, filed Aug. 1, 2019, the entire contents of which are incorporated herein by reference.

BACKGROUND

1. Field of the Invention

The present invention generally relates to industrial fans. More specifically, the invention relates to a tool for replacing the bushing in an industrial fan.

2. Description of Known Technology

Industrial fans are used in various industries, such as the power industry, to induce a draft for ventilation, cooling, exhaust or other purposes. The fans generally include a hub from which a plurality of blades, sometime twenty or more, extend radially outward. To mount the blades to the hub, the hub is provided with a corresponding number of radially oriented blade shafts. One blade is threadably mounted to each of the blade shafts, which is typically recessed within a bore in the perimeter of the hub.

For efficiency purposes, the fans are provided such that the pitch of the blades is variable, and more specifically, continuously variable during operation of the fan. Pitch adjustment is effectuated by synchronously rotating each of the blade shafts, and therefore, each of the blades. To support the blades while still allowing for relative rotation with respect to the hub about the blade shaft axis, a bushing is located within each of the bores provided about the periphery of the hub and through which the blade shafts extend. Thus, a bushing is located between the base of the blades and the portions of the hub defining the bores within which the blade shafts are located. These bushings are typically of a variety of the bushings known as Glacier bushings.

As a result of the continuous varying of the pitch of the blades during operation of the fan, the bushings are wear items and subject to periodic replacement. However, because of the narrow space within which the bushings are mounted, the bushings are not field serviceable. Replacement of the bushings therefore requires removal and complete disassembly and rebuilding of the entire hub assembly. Obviously, this results in significant down time for the fan and expense to the operator.

SUMMARY OF THE INVENTION

In view of the drawbacks involved with the replacement of the above mentioned industrial fan bushings, the present invention provides a tool enabling field service and replacement of the bushings without full disassembly of the hub of the fan.

Accordingly, in one aspect, the present invention provides a bushing installation tool having a plurality of spacer rods with first and second ends, a pressure plate and interchangeable first and second bases. The pressure plate is mounted to the first ends of the spacer rods. The first base includes portions configured to releasably engage the second ends of the spacer rods and includes portions configured to engage an end of a cylindrical bushing and to restrain radial expansion of a cylindrical bushing. The second base is alternatively interchangeable with the first base and also including portions configured to releasably engage the second ends of the spacer rods. The second base further includes portions configured to engage the end of the cylindrical bushing and to permit radial expansion of the cylindrical bushing.

In another aspect, the first base is annular in shape.

In a further aspect, the portion of the first base configured to receive an end of a cylindrical bushing includes a circumferential groove formed in the first base.

In an additional aspect, the circumferential groove is open in a direction facing the pressure plate.

In yet another aspect, the circumferential groove is adjacent to an outer perimeter of the first base.

In still a further aspect, the portions of the first base configured to engage the end of the cylindrical bushing are located radially outward of the portions of the first base configured to engage the second ends of the spacer bars.

In an additional aspect, the first base includes releasably engaged first and second halves.

In still another aspect, the first and second halves are arcuate in shape.

In yet a further aspect, one of the first and second halves includes a dowel pin extending from an end thereof and the other of the first and second halves includes a bore defined on an end thereof and configured to receive the dowel pin.

In an additional aspect, the first and second halves are releasably engaged by a securing plate fastened to each of the first and second halves and extending over a joint defined between the first and second halves.

In another aspect, the first base has around outer perimeter defining a first diameter and the second base has a round outer perimeter defining a second diameter.

In a further aspect, the first diameter is greater than the second diameter.

In yet an additional aspect, the second base is annular in shape.

In still another aspect, the portion of the second base configured to receive an end of a cylindrical bushing is a lip extending radially outward from an outer perimeter of the second base.

In a further aspect, the lip includes a face facing in a direction toward the pressure plate when the second plate is releasably engaged with spacer rods.

In still an additional aspect, the portions of the second base configured to engage the end of a cylindrical bushing are located radially outward of the portions of the second base configured to engage the second ends of the spacer bars.

In another aspect, the second base includes releasably engaged first and second halves, the first and second halves of the second base being arcuate in shape.

In yet a further aspect, a dowel pin extending from an end thereof and the other of the first and second halves of the second base includes a bore defined on an end thereof and configured to receive the dowel pin.

In an additional aspect, the first and second halves are releasably engaged by a securing plate fastened to each of the first and second halves and extending over a joint defined between the first and second halves.

In another aspect of the invention, a bushing installation tool is provided including a plurality of spacer rods having first and second ends; a pressure plate mounted to the first ends of the spacer rods; a first base, the first base having portions configured to engage an end of a cylindrical bushing and to restrain radial expansion of a cylindrical bushing engaged therewith; the bushing installation tool having a first stage, in the first stage the first base being releasably engage with the second ends of the spacer rods; a second base, the second base including portions configured to engage the end of the cylindrical bushing and to permit radial expansion of the cylindrical bushing engaged therewith, the second base also including portions configured to releasably engage the second ends of the spacer rods and being alternatively interchangeable with the first base; and the bushing installation tool having a second stage, in the second stage the second base being releasably engaged with the second ends of the spacer rods.

In still another aspect of the invention, a method for installing a bushing on an industrial fan is provided.

Various objects, features and advantages of the present invention will become readily apparent to persons skilled in the art upon a review of the presented description and claims, with reference to the drawings and illustrations appended hereto, and all of which form the specification of the present application.

DETAILED DESCRIPTION

Figure 1:
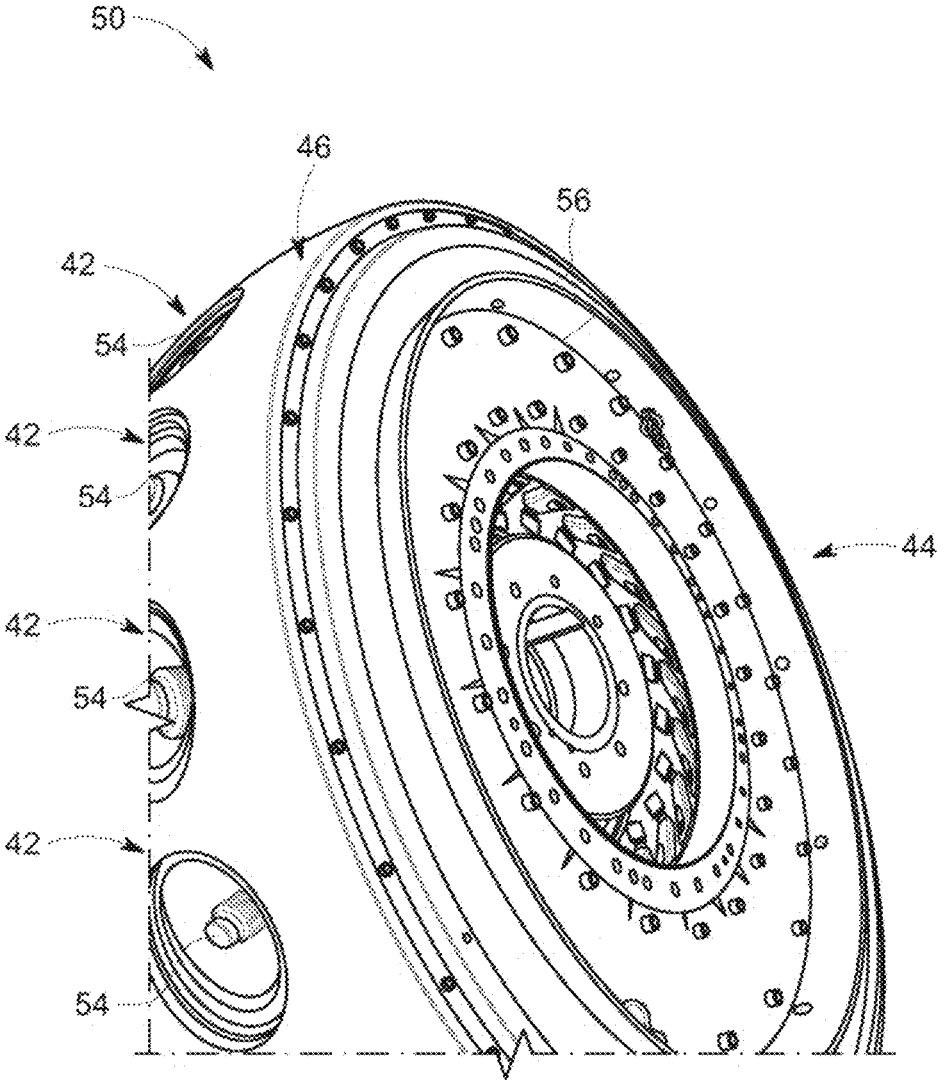
FIG. 1 shows the hub of an industrial fan, with the fan blades removed, and with which a tool embodying the principles of the present invention would be used.

As used in the description that follows, directional terms such as "upper" and "lower" are used with reference to the orientation of the elements as presented in the figures. Accordingly, "upper" indicates a direction toward the top of the figure and "lower" indicates a direction toward the bottom of the figure. The terms "left" and "right" are similarly interpreted. The terms "inward" or "inner" and "outward" or "outer" indicate a direction that is generally toward or away from a central axis of the referred to part whether or not such an access is designated in the figures. An axial surface is therefore one that faces in the axial direction. In other words, an axial surface faces in a direction along the central axis. A radial surface therefore faces radially, generally away from or toward the central axis. It will be understood, however, that in actual implementation, the directional references used herein may not necessarily correspond with the installation and orientation of the corresponding components or device.

Referring now to the drawings, a tool embodying the principles of the present invention is generally illustrated in the figures and designated at 10. The tool 10 includes as its principal components includes a pressure plate 12, spacer rods 14, a first base 16 (also referred to as the alignment and starting base 16), a second base 18 (also referred to as the finishing base 18), and a pair of securement plates 20.

The alignment and starting base 16 and the finishing base 18 are interchangeable with one another; the former being used in what is herein referred to as stage 1 of the tool, during initial positioning and alignment of the bushing, and the latter being used in what is referred to as stage 2 of the tool, during final setting of the bushing. The alignment and starting base 16 is generally seen in FIGS. 4-8, while the finishing base 18 is generally seen in FIGS. 14 and 15.

The alignment and starting base 16 and the finishing base 18 have generally similar constructions and the following discussion of the alignment and starting base 16 is equally applicable to the finishing base 18. In the discussion of the alignment and starting base 16, the reference numeral of the corresponding element of the finishing base 18 is provided in parenthesis.

The alignment and starting base 16 (18) is comprised of two semicircular base halves 16*a*, 16*b* (18*a*, 18*b*). To form the base 16 (18), the base halves 16*a*, 16*b* (18*a*, 18*b*) are pushed together end-to-end. Alignment and securement of the ends of the base halves is aided by the ends one base half 16*a* (18*a*) being provided with permanently installed dowel pins 21 while the ends of the other base half 16*b* (18*b*) are provided with bores 23 to receive the dowel pins 21.

The base halves 16*a*, 16*b* (18*a*, 18*b*) are secured together to form the base 16 (18) using two securement plates 20. One securement plate 20 spans each joint 17 (19) between the adjacent ends of the base halves 16*a*, 16*b* (18*a*, 18*b*). The securement plates 20 are bolted to the adjacent ends of both base halves using threaded fasteners 25, such as cap screws. As such, when bolted to the adjacent ends, the securement plates 20 prevent the halves from separating and the base halves 16*a*, 16*b* (18*a*, 18*b*), when joined together, generally form an annular ring.

The base 16 (18) is provided with threaded bores 27 (29) that receive threaded ends 31 of the spacer rods 14. When the tool 10 is fully assembled, the pressure plate 12 is mounted to the opposing ends 33 of the spacer rods 14. To facilitate mounting of the pressure plate 12, the opposing ends 33 of the spacer rods 14 are also threaded and provided with a lower stop nut 35L. The threaded ends 33 of the spacer rods 14 above the stop nut 35L are inserted through bores 37 defined in the pressure plate 12 and, to retain the pressure plate 12 thereon, upper stop nuts 35U are threaded onto the terminal ends 33 of the rods 14 protruding from the upper side of the top pressure plate 12. The upper and lower stop nuts 35U, 35L thus secure pressure plate to the spacer rods 14.

As noted above, the alignment and starting base 16 is used during stage 1. This stage involves general alignment and starting of a bushing 40 within a blade pocket 42 of the hub 44 so as to pre-set the bushing 40 within the hub 44.

Figure 2:
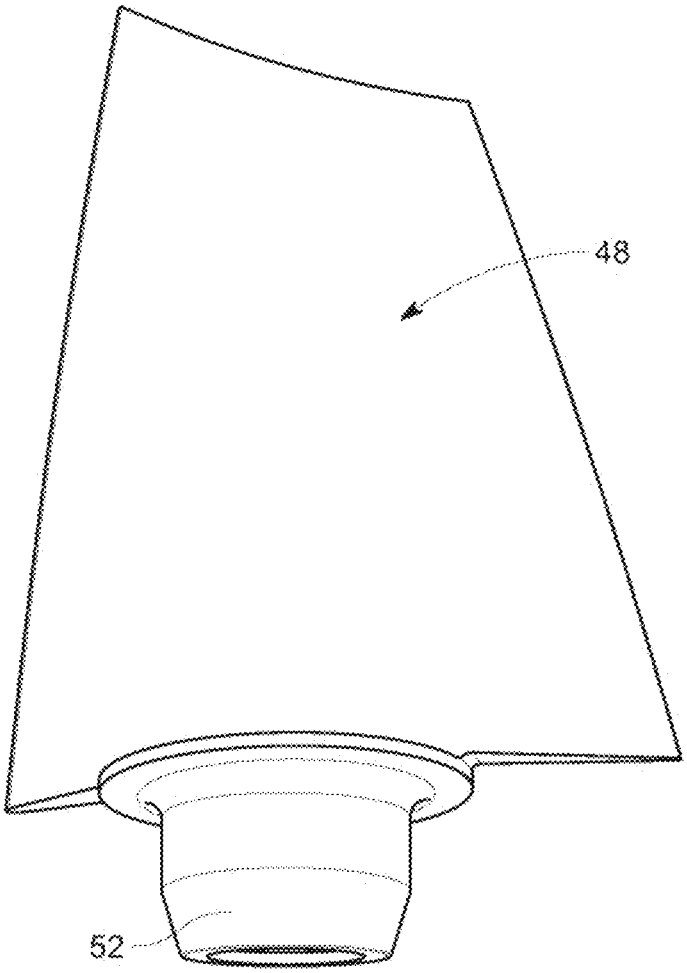
FIG. 2 shows a fan blade as would be as would be mounted about the perimeter of the hub seen in FIG. 1.
Figure 3:
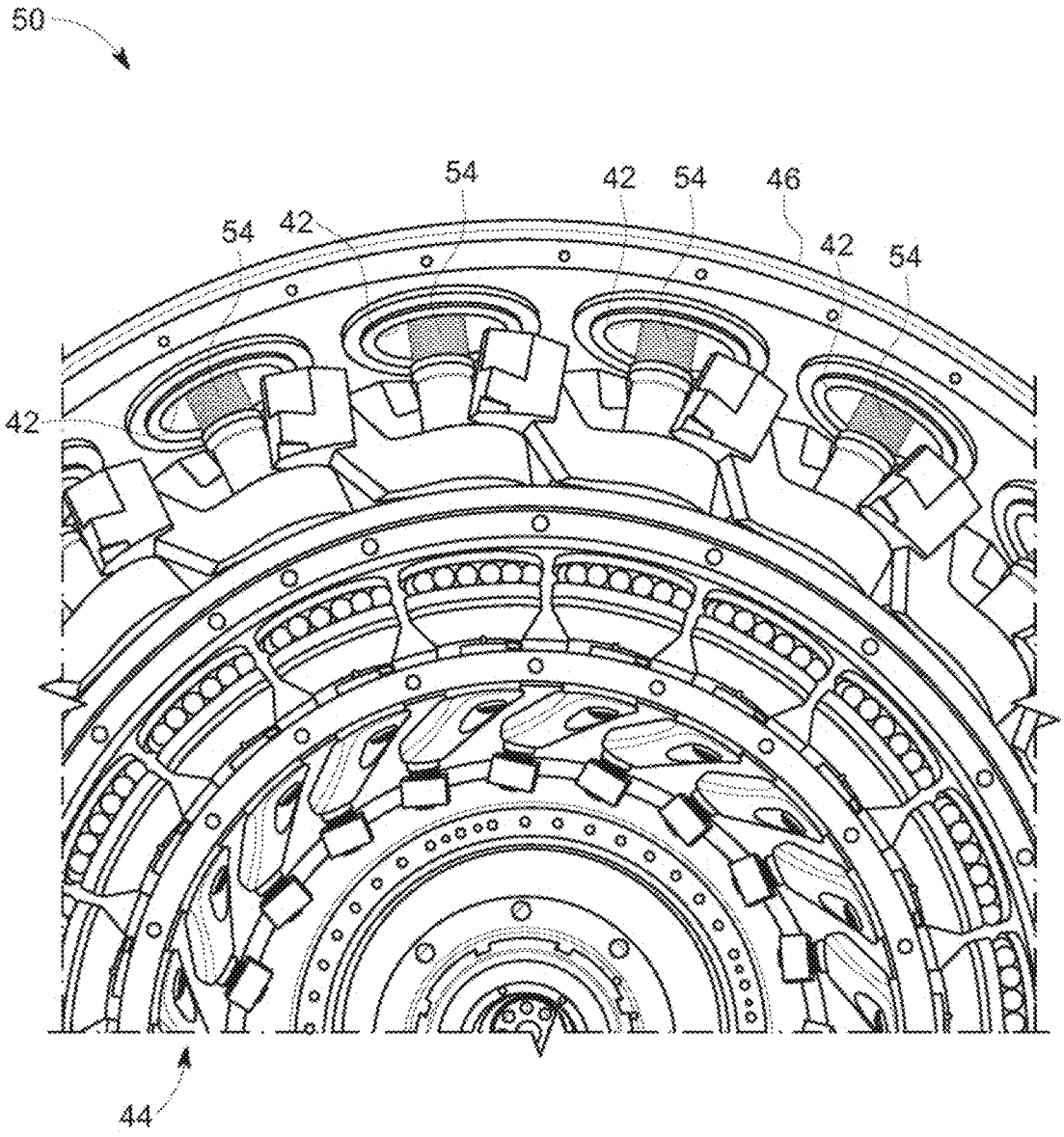
FIG. 3 shows an enlarged portion of the hub of FIG. 1, with the front covers removed, and showing threaded spindles to which the blades are mounted and the area in with the tool of the present invention is used.
Figure 4:
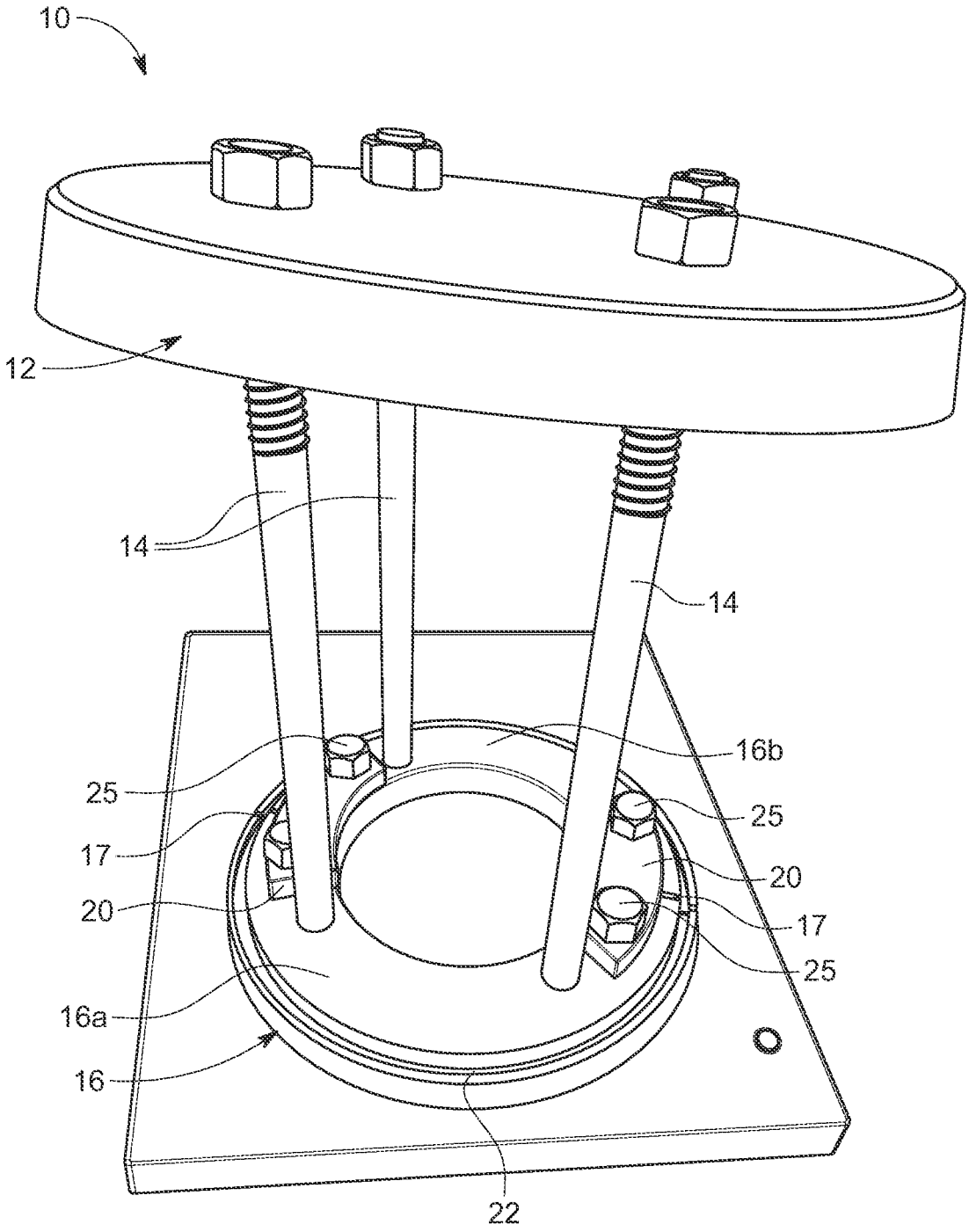
FIG. 4 shows the tool, in stage 1, with the alignment and starting base attached.

As is well known in the industry, fan blades 48 are mounted about the perimeter 46 of the hub 44 of a fan 50 by inserting a fan blade collar 52 into the blade pocket 42 and threadably engaging the collar 52 on a threaded shaft or spindle 54. Presented in FIG. 1 is the hub 44 of a fan 50, with the blades 48 removed therefrom from the threaded spindles 54 of the hub 44. FIG. 2 illustrates a blade 48, and its associated collar 52, removed from the hub 44 of FIG. 1. In FIG. 3, a portion of the hub 44 is illustrated with its cover 56 (seen in FIG. 1) removed so as to better illustrate the blade pockets 42 and threaded spindles 54 of the hub 44.

With the present invention, when servicing the fan 50, the entire fan 50, including its hub 44, does not need to be disassembled. Rather, only the fans blades 48 need to be removed from the hub 44. The hub cover 56, shown attached in FIG. 1 and removed in FIG. 3, remains on the hub 44 during use of the herein described tool 10.

With the cover 56 remaining on the hub 44, the fan blades 48 are removed to expose the blade pockets 42 and the spindles 54.

With the blades 48 remaining removed, the base halves 16*a*, 16*b* of the alignment and starting base 16 are separately inserted through the blade pocket 42 with one of the spacer rods 14 attached thereto. Preferably only one of the spacer rods 14 is attached to each base half 16*a*, 16*b* making it easier to manipulate the base halves 16*a*, 16*b* through the blade pocket 42 alongside of the spindle 54. The alignment and starting base 16 is then assembled beneath the blade pocket 42 and about the blade spindle 54 by inserting the remaining spacer rods 14 for each base half 16*a*, 16*b*, into the threaded bores 27, and by then inserting the dowels 21 of the one base half 16*a* into the bores 23 of the other base half 16*b*. With the dowels 21 located in their cooperating bores 23, the securement plates 20 are fastened by the cap screws 25 to the base halves 16*a*, 16*b* across the joints 17.

Figure 5:
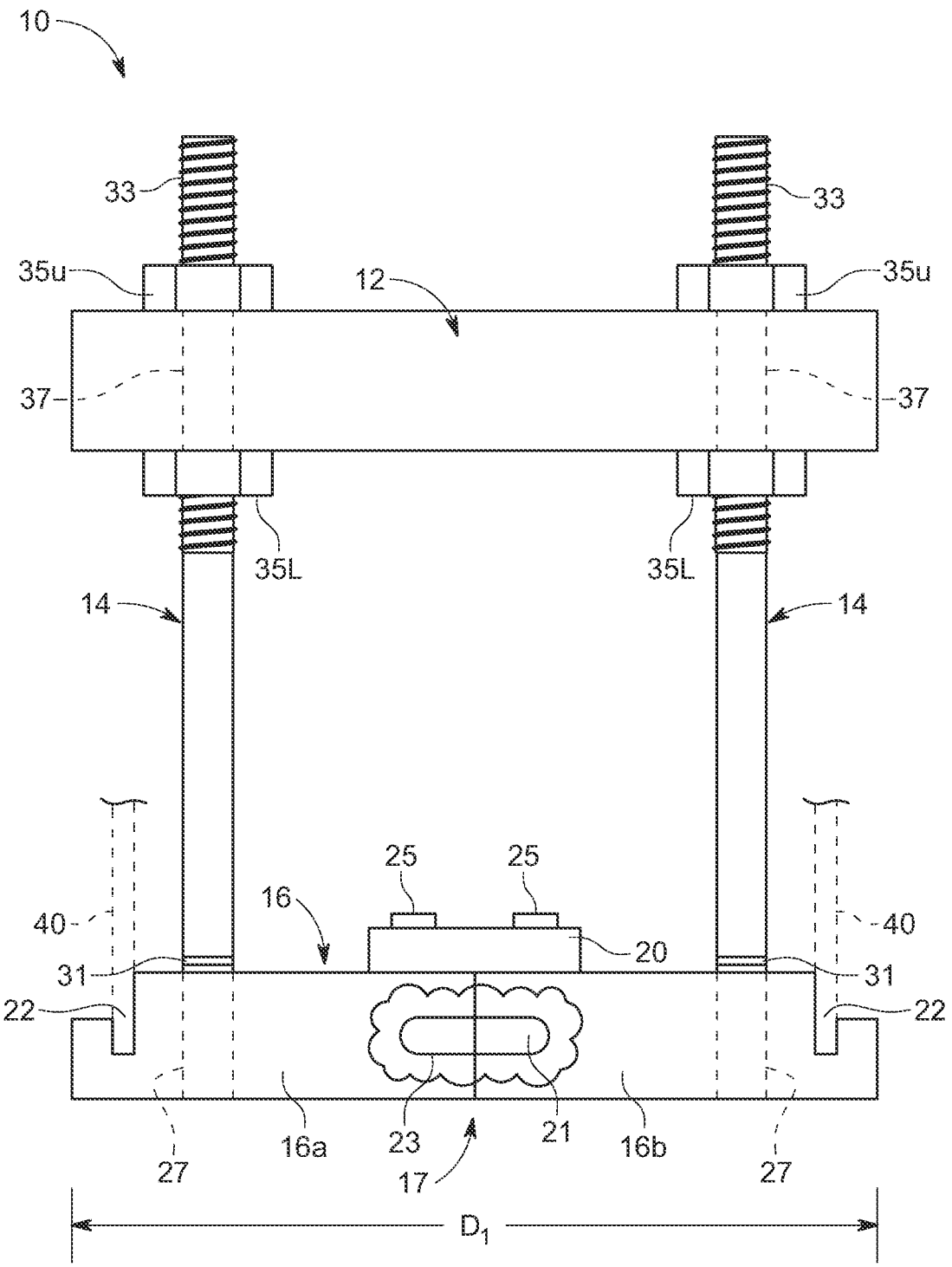
FIG. 5 is a side view illustrating the tool seen in FIG. 4.
Figure 6:
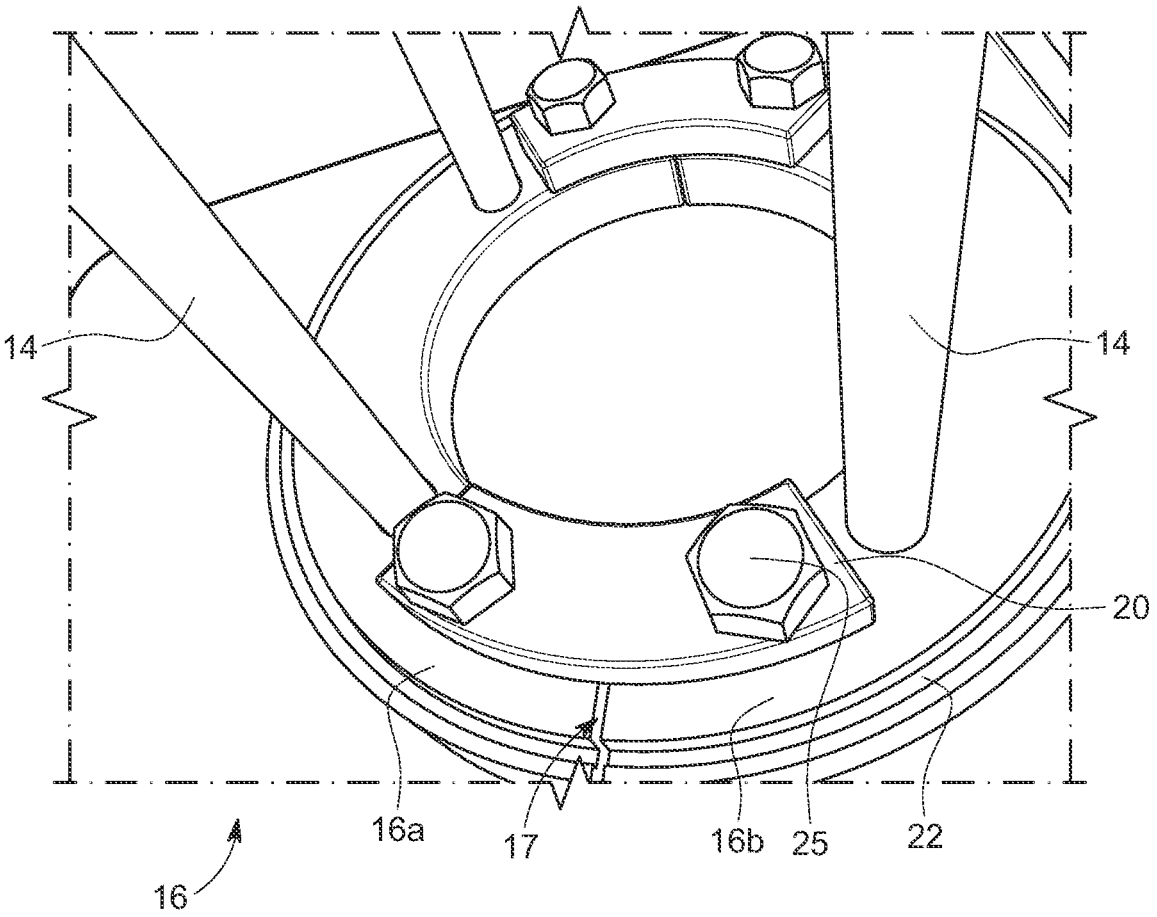
FIG. 6 is an enlarged view of the alignment and starting base seen in FIGS. 4 and 5.
Figure 7A:
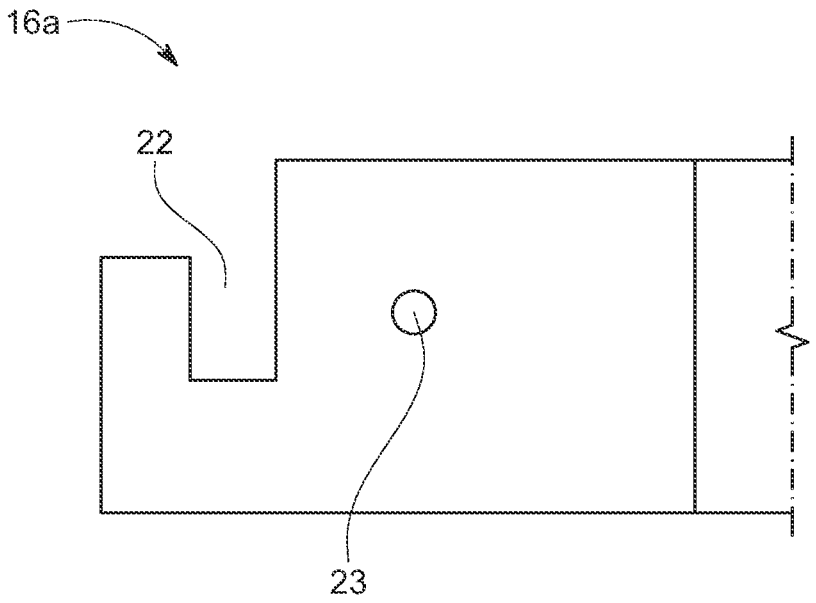
FIG. 7A shows an end view of the alignment and starting base and particularly shows the dowel bore seen in FIG. 5.
Figure 7B:
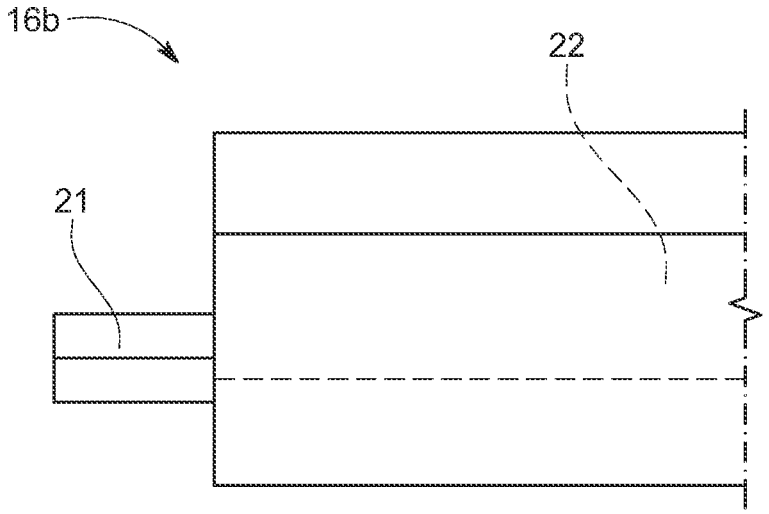
FIG. 7B shows a side view of the alignment and starting base and particularly shows the down pin 21 seen in FIG. 5.
Figure 8A:
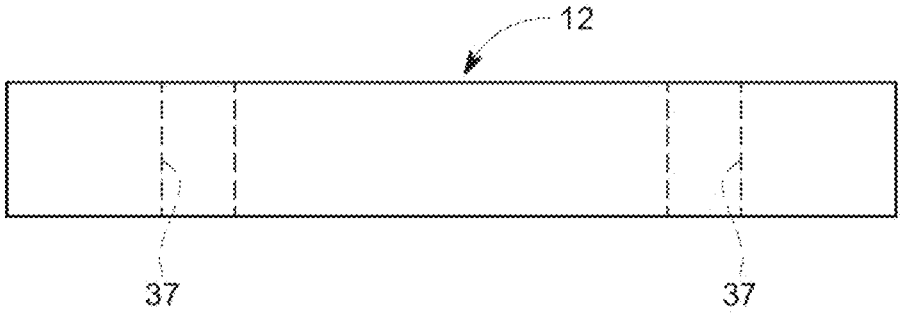
FIG. 8A is an isolated side view of the pressure plate of the tool that is used in both stage 1 and stage 2 of the tool.
Figure 8B:
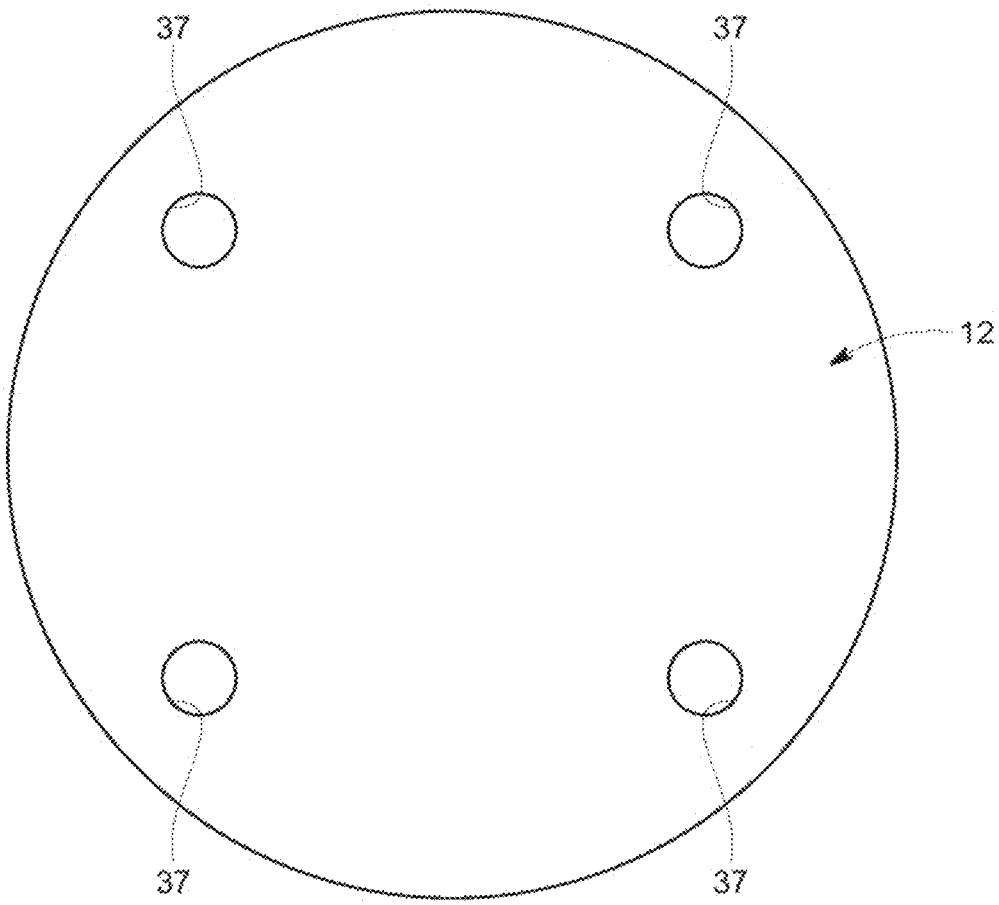
FIG. 8B is a top plan view of the pressure plate seen in FIG. 8A.

The bushing 40, which is a cylindrical split bushing, is manually collapsed into a reduced diameter by overlapping its ends 41. In this overlapped, reduced diameter condition, the bushing is then inserted over the spindle 54 and through the blade pocket 42. Once through the blade pocket 42, the collapsed bushing 40 is released and expanded so as to be captured in a groove 22 defined in an upper surface of the alignment and starting base 16, generally adjacent to the perimeter of the base 16. The lower end of the collapsed bushing 40, shown in phantom in FIG. 5, is captured by being received in the groove 22 of the alignment and starting base 16.

Figure 10:
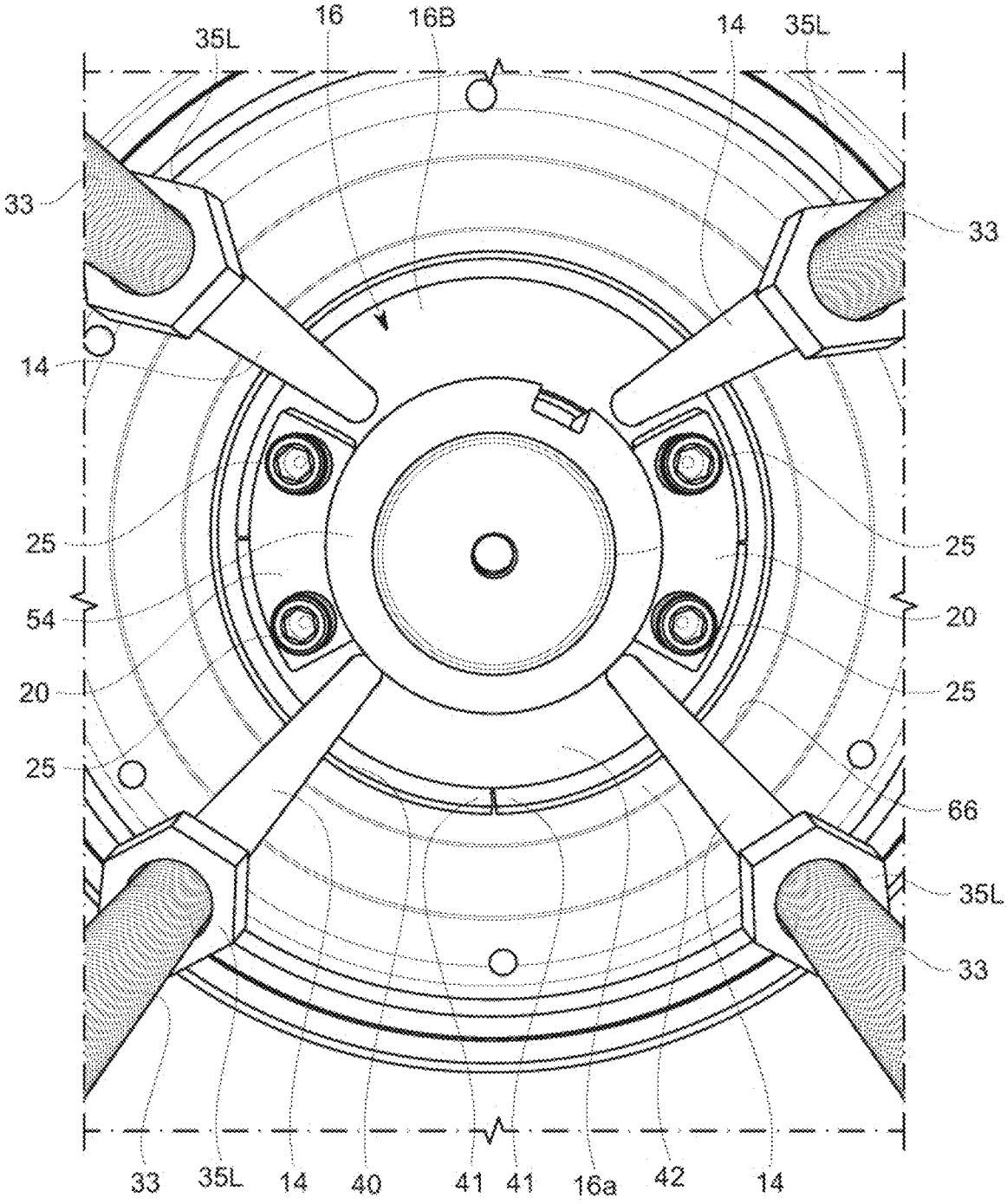
FIG. 10 is a top plan view showing the alignment and starting base located about the threaded blade spindle of the hub and with a Glacier bushing captured/positioned in the recessed groove of the alignment and starting base.

Once captured in the groove 22, the bushing 40 is retained therein in a condition having a slightly reduced diameter relative to the diameter of the blade pocket 42. Generally, the split ends 41 of the bushing 40 are touching or immediately adjacent to one another while in the groove, as seen in FIG. 10. In this position, the bushing 40 is still slightly collapsed from its in use diameter. This collapsed and captured state of the bushing 40 allows it to readily fit be positioned within the blade pocket 42 about the spindle 54, before final installation in the pocket 42 during stage 2 described below. Because of the narrow gap between the blade pocket 42 and the spindle 54 in the unassembled hub 44, it is not possible to manually manipulate the bushing 40 while retaining it in a collapsed state for installation and proper seating the bushing within the blade pocket 42, which is possible with the present tool 10.

Figure 11:
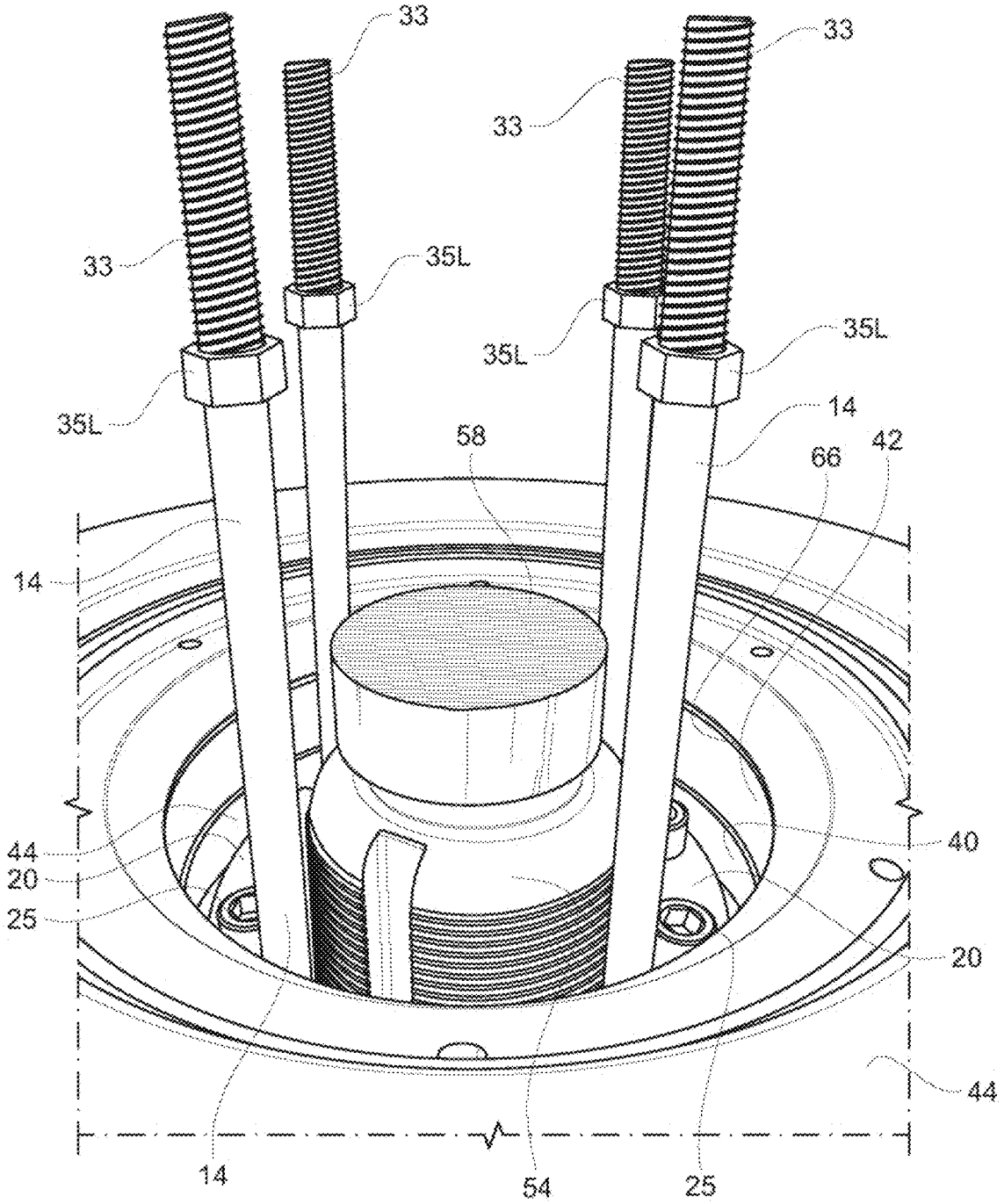
FIG. 11 is a perspective view of FIG. 10 before installation of the pressure plate, but after positioning of a brass block on the top of the blade spindle.

Next, with the bushing 40 captured in the alignment and starting base 16 about the spindle 54 below the blade pocket 42, the remaining spacer rods 14 are mounted in their threaded bores 27 to the alignment and starting base 16 so that they too extend up through the blade pocket 42, as generally seen in FIGS. 10 and 11. Alternately, all of the spacer rods 14 may be mounted to the alignment and starting base 16 prior to insertion and capturing of the bushing 40 on the base 16. With the spacer rods 14 installed, a brass block 58 is positioned on the end of the spindle 54 blade shaft. The brass block 58 is used to protect the spindle 54 from damage during positioning of the bushing 40, as further discussed below.

A hydraulic ram 60 is next placed on top of the brass block 58 and connected to a hydraulic pump (not shown), which may be a manual hydraulic pump, via a fitting 62 and hydraulic line 64. Thereafter, the pressure plate 12 is lowered over the ends 33 of the spacer rods 14, onto the lower stop nuts 35L, and evenly secured by the upper stop nuts 35U. The stop nuts 35L, 35U are used oriented to keep the tool 10 and bushing 40 square to the blade pocket 42. Alternatively, the pressure plate 12 may be mounted to the spacer rods 14 prior to placement of the brass block 58 and hydraulic ram 60 between the end of the spindle 54 and pressure plate 12.

Assembled and positioned in this manner, the hydraulic pump is actuated and hydraulic pressure applied via the ram 60 to the top pressure plate 12. With the bushing 40 square to the blade pocket 42, the hydraulic ram 60 continues to be extended, forcing the pressure plate 12 and alignment and starting base 16 upward and pulling the bushing 40 into engagement with the blade pocket 42. Notably, the outer diameter D1 of the alignment and starting base 16 is greater than the inner diameter of the blade pocket 42 and the state of the bushing 40 captured in the groove 22. As a result, the tool 10 is stopped before the bushing 40 is fully pulled into and seated within the blade pocket 42. The alignment and starting base 16 is thus only used to pre-set the bushing 40 in the blade pocket 42.

With the bushing 40 pre-set in the blade pocket 42, the ram 60 is released, the tool 10 disassembled and the alignment and starting base 16 removed from the blade pocket 42. It is noted that with the securement plates 20 removed, the base halves 16*a*, 16*b* of the alignment and starting base 16 can be manipulated so as to be removed between the now pre-set bushing 40 and spindle 54.

Next, the tool 10 is reassembled with the finishing base 18, instead of the alignment and starting base 16, in a manner similar to that discussed above for stage 2 of the bushing 40 installation.

First, the base halves 18*a*, 18*b* of the finishing base 18 oriented and manipulated so as to insert them between the pre-set bushing 40 and spindle 54 and to a location beneath the blade pocket 42. Thereafter, the base halves 18*a*, 18*b* are assembled together and positioned about the blade shaft below the blade pocket by inserting the dowels 24 of one finishing base half 18*b* into corresponding bores 24 of the other finishing base half 18*b*. With the base halves 18*a*, 18*b* together, they are secured in this position using the securement plates and cap screws 25. If not already attached, any remaining spacer rods 14 are mounted in the threaded bores 29 of the finishing base 18 so as to extend up through the blade pocket 42 between the spindle 54 and the pre-set bushing 40.

Similar to stage 1, the brass block 58 is re-positioned on the end of the blade shaft and the hydraulic ram 60 is placed on top of the brass block 58 and connected to the hydraulic pump. The pressure plate 12 is again positioned over the ends 33 of the spacer rods 14, onto the stop nuts 35L, and evenly secured by the stop nuts 35U.

Figure 9:
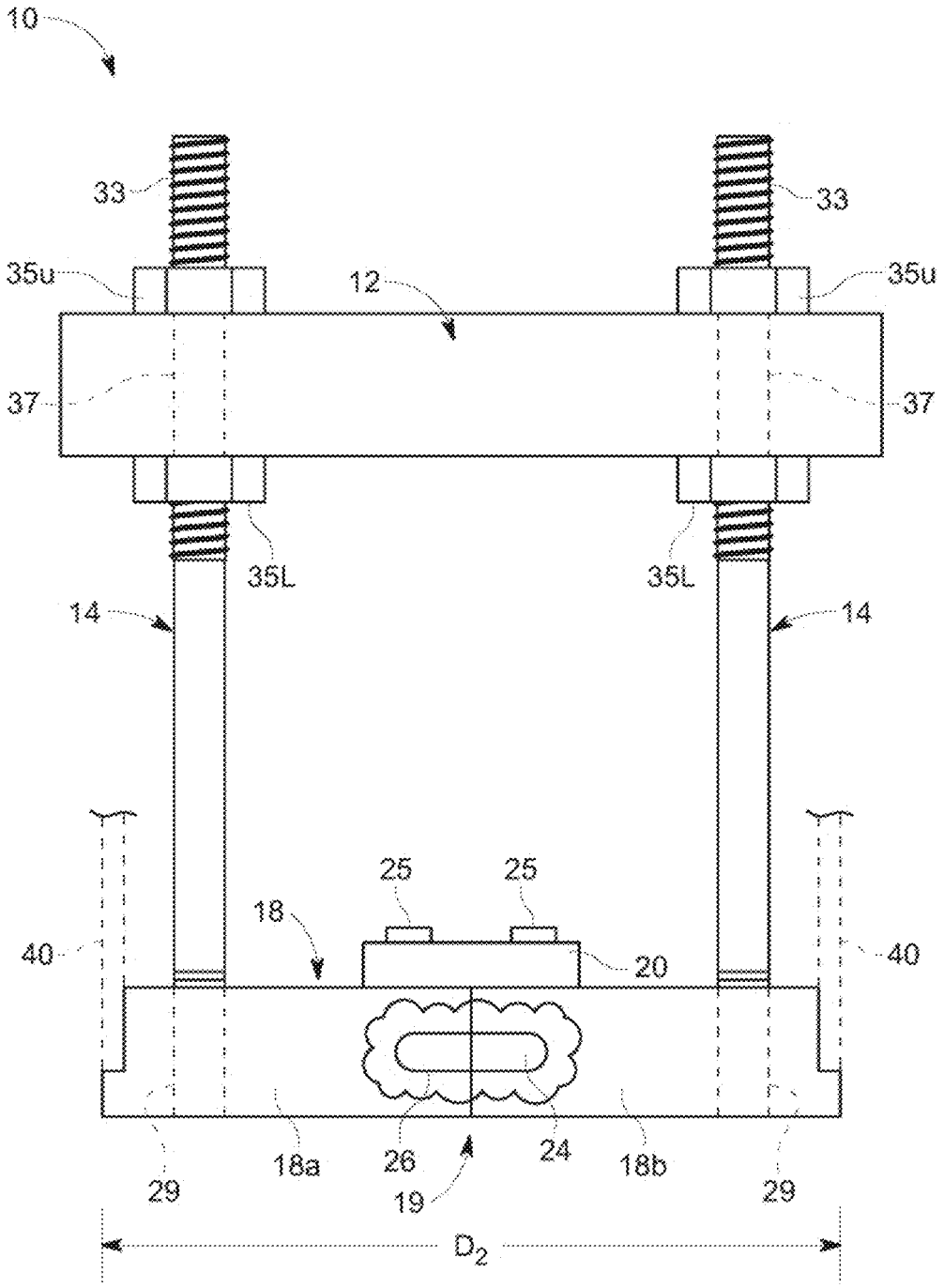
FIG. 9 is a side view of the tool, in stage 2, with the finishing base attached to the pressure plate and rods and with portions broken away to illustrate one of the dowel pins extending between the two halves of the finishing base into a dowel bore in the other of the two halves.
Figure 12:
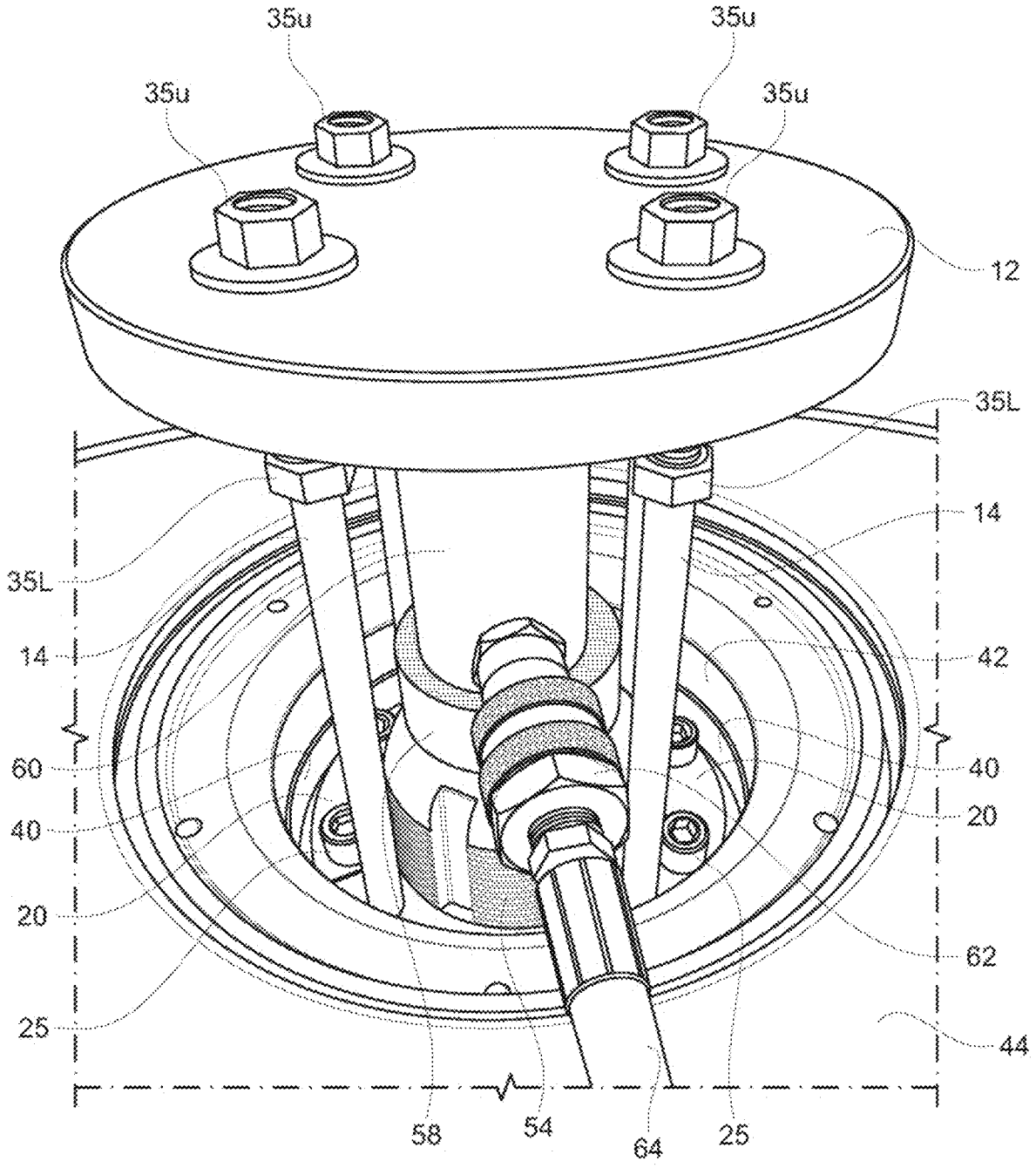
FIG. 12 is a perspective view, similar to FIG. 11, after installation of the tool's top pressure plate and positioning a hydraulic press between the top pressure plate and the brass block.

Assembled and positioned in this manner, the hydraulic pump is actuated and pressure applied via the ram 58 to the pressure plate 12. Unlike the alignment and starting base 16, the outer diameter D2 of the finishing base 18 is substantially the same as, or slightly less, than diameter of the blade pocket 42 and is not configured to restrict radial expansion of the bushing 40. Rather, the perimeter of the finishing base 18 may be provided with an outwardly directed lip 65 to receive the end of the bushing 40 thereon, as seen in FIG. 9. Optionally, the lip 65 may be omitted and the Sized in this manner, with the finishing base 18 installed, the tool 10 can therefore evenly pull the bushing into the blade pocket by activating the hydraulic ram. This is performed until the bushing is fully seated against a stop edge 66 formed in the blade pocket 42, and which can be seen in FIGS. 10-12. With the new bushing fully seated, the tool 10 may then be re-disassembled and removed from the hub 44 of the fan 50 through the gap between the installed bushing 40 and spindle 54.

The above description is meant to be illustrative of at least one preferred implementation incorporating the principles of the invention. One skilled in the art will really appreciate that the invention is susceptible to modification, variation and change without departing from the true spirit and fair scope of the invention, as defined in the claims that follow. The terminology used herein is therefore intended to be understood in the nature of words of description and not words of limitation.

I claim:

1. A bushing installation tool comprising:

a plurality of spacer rods having first and second ends;

a pressure plate mounted to the first ends of the spacer rods;

a first base, the first base including portions configured to releasably engage the second ends of the spacer rods and retain the first base in a fixed position along the spacer rods, the first base having portions facing in the longitudinal direction of the spacer rods and configured to engage an end of a cylindrical bushing in a radially collapsed position and restrain radial expansion of the cylindrical bushing is the radially collapsed position engaged therewith; and a second base being alternatively interchangeable with the first base, the second base also including portions configured to releasably engage the second ends of the spacer rods and retain the second base in a fixed position along the spacer rods, the second base having portions facing in the longitudinal direction of the spacer rods and configured to engage the end of the cylindrical bushing and to permit radial expansion of the cylindrical bushing engaged therewith.

2. The bushing installation tool according to claim 1, wherein the first base is annular in shape.

3. The bushing installation tool according to claim 1, wherein the portion of the first base configured to receive an end of the cylindrical bushing includes a circumferential groove formed in the first base.

4. The bushing installation tool according to claim 3, wherein the circumferential groove is open in a direction facing the pressure plate.

5. The bushing installation tool according to claim 3, wherein the circumferential groove is adjacent to an outer perimeter of the first base.

6. The bushing installation tool according to claim 1, wherein the portions of the first base configured to engage the end of the cylindrical bushing are located radially outward of the portions of the first base configured to engage the second ends of the spacer rods.

7. The bushing installation tool according to claim 1, wherein the first base includes releasably engaged first and second halves.

8. The bushing installation tool according to claim 7, wherein the first and second halves are arcuate in shape.

9. The bushing installation tool according to claim 8, wherein one of the first and second halves includes a dowel pin extending from an end thereof and the other of the first and second halves includes a bore defined on an end thereof and configured to receive the dowel pin.

10. The bushing installation tool according to claim 7, wherein the first and second halves are releasably engaged by a securing plate fastened to each of the first and second halves and extending over a joint defined between the first and second halves.

11. The bushing installation tool according to claim 1, wherein the first base has a round outer perimeter defining a first diameter and the second base has a round outer perimeter defining a second diameter.

12. The bushing installation tool according to claim 11, wherein the first diameter is greater than the second diameter.

13. The bushing installation tool according to claim 1, wherein the second base is annular in shape.

14. The bushing installation tool according to claim 1, wherein the portion of the second base configured to receive the end of the cylindrical bushing is a lip extending radially outward from an outer perimeter of the second base.

15. The bushing installation tool according to claim 14, wherein the lip includes a face facing in a direction toward the pressure plate when the second base is releasably engaged with spacer rods.

16. The bushing installation tool according to claim 1, wherein the portions of the second base configured to engage the end of the cylindrical bushing are located radially outward of the portions of the second base configured to engage the second ends of the spacer rods.

17. The bushing installation tool according to claim 1, wherein the second base includes releasably engaged first and second halves, the first and second halves of the second base being arcuate in shape.

18. The bushing installation tool according to claim 17, wherein one of the first and second halves includes a dowel pin extending from an end thereof and the other of the first and second halves includes a bore defined on an end thereof and configured to receive the dowel pin.

19. The bushing installation tool according to claim 17, wherein the first and second halves are releasably engaged by a securing plate fastened to each of the first and second halves and extending over a joint defined between the first and second halves.

20. A bushing installation tool comprising:

a plurality of spacer rods having first and second ends;

a pressure plate mounted to the first ends of the spacer rods;

a first base, the first base having portions configured to engage an end of a radially collapsed cylindrical bushing and to restrain radial expansion of the radially collapsed cylindrical bushing received therein;

the bushing installation tool having a first stage, in the first stage the first base being releasably engaged with the second ends of the spacer rods and retained in a fixed position along the spacer rods;

a second base alternatively interchangeable with the first base, the second base including portions configured to engage the end of the cylindrical bushing and to permit radial expansion of the cylindrical bushing engaged therewith; and the bushing installation tool having a second stage, in the second stage the second base being releasably engaged with the second ends of the spacer rods and retained in a fixed position along the spacer rods.

* * * * *